United States Patent [19]

Staudinger et al.

[11] 4,019,730

[45] Apr. 26, 1977

[54] ENVELOPE STACKING SYSTEM

[75] Inventors: Frederick J. Staudinger, North Salem, N.Y.; James G. Montagnino, Monroe, Conn.

[73] Assignee: Pitney-Bowes, Inc., Stamford, Conn.

[22] Filed: July 23, 1976

[21] Appl. No.: 708,260

Related U.S. Application Data

[63] Continuation-in-part of Ser. No. 584,001, June 5, 1975, abandoned.

[52] U.S. Cl. ..... 271/181; 214/7; 271/214

[51] Int. Cl.[2] ..... B65H 29/44

[58] Field of Search ..... 271/181, 180, 177, 178, 271/179, 214; 214/7

[56] References Cited

UNITED STATES PATENTS

| | | | |
|---|---|---|---|
| 2,787,468 | 4/1957 | Novick | 271/181 |
| 3,078,089 | 2/1963 | Maidment | 271/179 |
| 3,131,932 | 5/1964 | Maidment | 271/181 X |
| 3,667,623 | 6/1972 | Frazier et al. | 271/181 X |
| 3,814,415 | 6/1974 | Hunter et al. | 271/181 |

*Primary Examiner*—Evon C. Blunk
*Assistant Examiner*—Bruce H. Stoner, Jr.
*Attorney, Agent, or Firm*—William D. Soltow, Jr.; Albert W. Scribner; Robert S. Salzman

[57] ABSTRACT

An envelope stacking system is described which has a wide-angled inlet window for easily inserting envelopes upon an envelope stacking deck. The envelopes are thrust towards a guide wall by means of constantly rotating friction rollers. Once an incoming envelope is received it is displaced from the friction rollers to prevent damage to the envelope. The displacement of the envelope also serves the purpose of freeing the inlet for the next incoming envelope. In this way, the inlet window is cleared to accommodate each incoming envelope. The stack is biased toward the inlet and friction rollers, but a lip disposed upon the deck prevents the stack from blocking the inlet window or from engaging with the friction rollers.

5 Claims, 6 Drawing Figures

ENVELOPE STACKING SYSTEM

RELATED APPLICATION

This application is a continuation-in-part of application Ser. No. 584,001, filed June 5, 1975, now abandoned.

This invention pertains to an envelope stacking system, and more particularly to an envelope stacking system having an expandable, wide-angled inlet window.

BACKGROUND OF THE INVENTION

One of the most serious problems in the handling of mail or envelopes is stacking. It is desirable to feed letters to a stack of letters, where the insertion of the envelopes is easily accomplished and the integrity of the stack of mail is properly maintained. With present equipment, letters are forced by rotating paddles or brushes into a stack of mail under compresssive load. The load applied to the stack is necessary to maintain the integrity of the pieces of mail as a unit mass. However, this stack pressure causes the incoming pieces of mail to meet with a large frictional resistance. This often results in jamming. In order to overcome this resistance, paddles or rollers propelling the mail are made to rotate at higher speeds. The added speed, however, causes greater wear damage to the envelopes. Also, the higher speed imparts more energy to the envelopes, which causes them to bounce out of the stack.

Intermixed mail of different sizes and weight is particularly a problem. The fixed speeds of the paddles, and the fixed pressure of the stack cannot automatically varied to accommodate large variations in the letter weight and size. Adjusted to light letters, the stacking system often tends to jam for heavier pieces of mail. Adjusted for heavier pieces, the lighter pieces often tend to bounce out of the stack.

The present invention seeks to eliminate the aforementioned problems by providing a self-clearing wide-angled inlet window for easy letter insertion. The stack of mail is held conveniently away from the inlet window and the rotating rollers, to prevent jamming and wear.

SUMMARY OF THE INVENTION

The invention relates to an envelope stacking system having an inlet window with a wide-angled throat for the easy insertion of envelopes to a stack of mail. A supportive deck is provided for carrying the stacked envelopes. The deck has a guide wall toward which incoming envelopes are propelled. The guide wall provides that each edge of an envelope will be in registry with the other envelope edges, this providing a uniform stack.

Incoming envelopes are thrust towards the guide wall by means of rotating friction rollers. Once an incoming letter is disposed upon the guide wall, it is pushed toward the stack of envelopes and becomes an integral part of this envelope mass. The stack of envelopes is biased towards the inlet window and the friction rollers, but is prevented from moving towards them by means of a limiting abutment or lip disposed on the deck. This serves the purpose of preventing wear and allowing the inlet window to remain open for subsequent incoming letters. The inlet window of the deck is periodically being cleared, so that each subsequent piece of mail can be easily inserted into the stack of envelopes.

Bounding is eliminated by providing a shock absorbing surface on the guide wall.

It is an object of this invention to provide an improved envelope stacking system;

It is another object of the invention to provide a stacking system for envelopes which will not be subjected to jamming, wear, and bouncing of the envelopes;

It is further object of this invention to provide an envelope stacking system which can handle intermixed envelopes of various weights and sizes.

These and other objects of the invention will become more apparent and will be better understood with reference to the following detailed description taken in conjunction with the attached drawings, in which.

Figure 1:
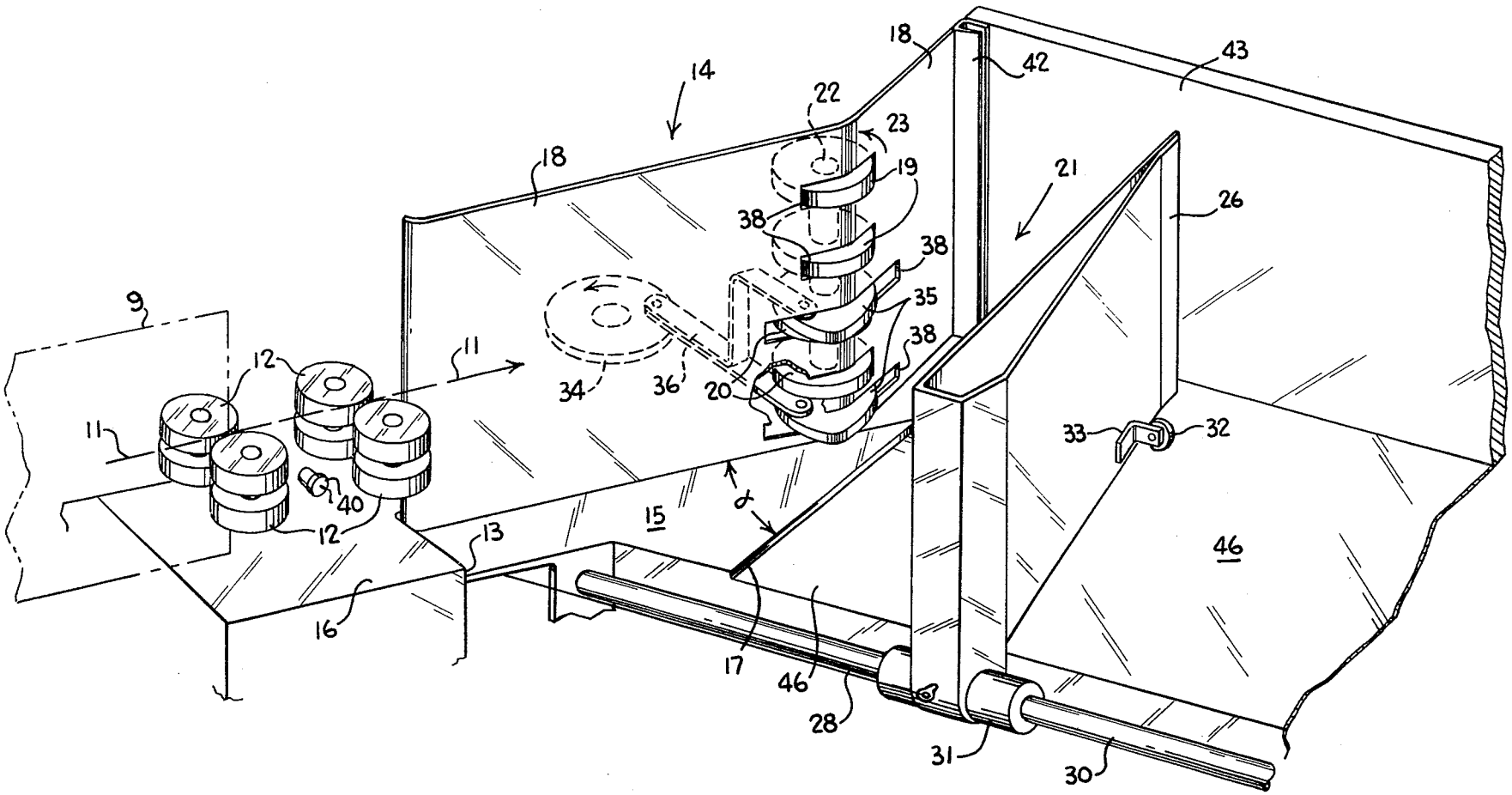
FIG. 1 is a persepctive view of the envelope stacking system of this invention.

FIG. *3a* through *3d* are sequential schematic views showing the functioning of the envelope stacking system of FIG. 1.

Generally speaking, the invention is for an envelope stacking system. Means are provided for transporting envelopes to a stacking deck. The stacking deck as an inlet window through which incoming envelopes are directed towards a driving means and a stack of envelopes carried by the deck. The inlet window has a wide-angled throat for easy insertion of the incoming envelope into the stack. Having entered the inlet, an envelope will engage with the driving means and be fully moved upon the deck. The stack of envelopes is biased toward the driving means, but is limited from coming in contact with the driving means. The stack is also limited from blocking the inlet window, so that an open or cleared inlet will be provided for subsequent incoming envelopes.

Figure 2:
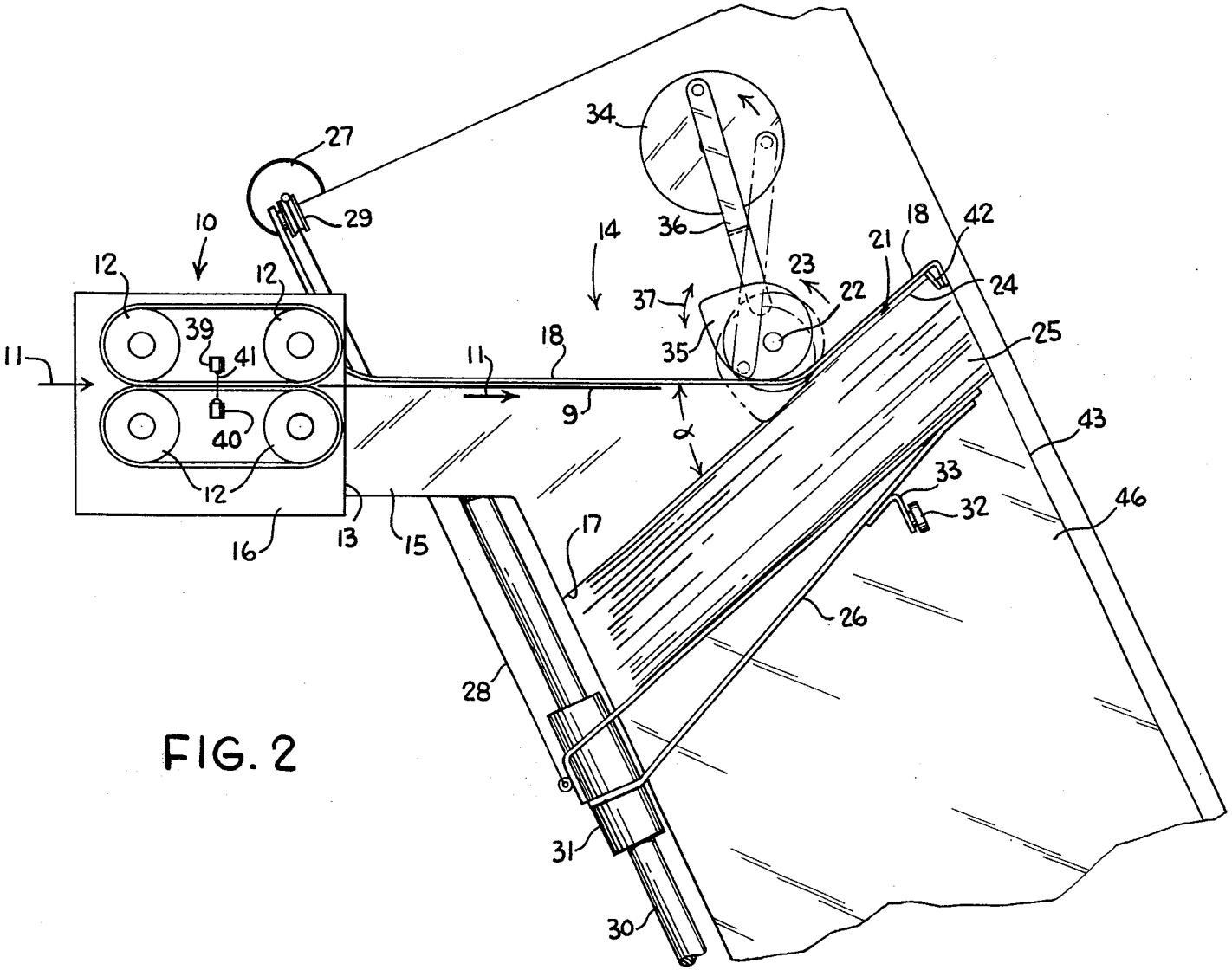
FIG. 2 is a top view of the envelope stacking system of FIG. 1.

Now referring to FIGS. 1 and 2, an envelope transort mechanism is generally shown by arrow 10. An envelope 9 is made to move along a feed path 11 between the transfer roller pairs 12 of the transport mechanism 10. The transfer rollers 12 deliver the envelope 9 to a stacking deck generally shown by arrow 14. The floor 15 of the deck 14 is generally ⅛ to 5/16 inch below the floor 16 of the transport mechanism 10 forming a lip 13 (nominally ¼ inch). Thus, the envelope 9 leaving transfer rollers 12 will drop (free flight) to the floor 15 of deck 14 as it moves along feed path 11. The envelope 9 is guided by a guide wall 18 to a double pair of frictional drive rollers 19 and 20, respectively (FIG. 1). The upper pair of friction rollers 19 have a low coefficient of friction with respect to paper, of approximately 0.25 (steel with respect to 20 No. bond).

The lower drive roller pair 20 has a high coefficient of friction of between 1.3 and 2.1 (nominal 1.7).

Rollers 19 and 20 are respectively keyed to a common drive shaft 22. All the drive rollers rotate in the direction shown by arrow 23. These drive rollers engage with an incoming envelope, and frictionally thrust the envelope into the slot 21 formed between the guide wall 18 and the rear most envelope 24 of envelope stack 25 (FIG. 2). A shock absorbing surface 42 is disposed on a side rear wall 43.

As will be seen with particular attention to FIG. 2, an inlet window $\alpha$ preceding the slot 21 has a wide-angle to allow easy insertion of the envelope into slot 21. The inlet window $\alpha$ has an angle of between 25° and 45°.

The angle is defined by back plate 18 and lip 17 in floor 15.

Envelope stack 25 (FIG. 2) is being continuously built-up from incoming envelopes such as envelope 9. The stack 25 is under compressive load by means fo biasing plate 26, which pushes the stack 25 towards drive rollers 19 and 20. The force exerted upon the stack 25 is for maintaining its integrity as a unit mass of envelopes. This force is created by the weight 27 (FIG. 2) at the back of the deck. Weight 27 pulls the plate 26 by means of the connecting guy-wire 28, which passes over pulley 29.

Plate 26 is slidably movable on shaft 30 by means of a ball-bushing 31. A tail-wheel 32 is also rotatably connected to plate 26 via bracket 33 for lending rolling support to plate 26 as it moves over floor 15.

A solenoid (not shown) which operates a single revolution clutch 34 operates a dual cam 35 through linkage 36. Cams 35 are connected to clutch 34 in such a way, that it oscillates back and forth (arrows 37 of FIG. 2) for each single revolution of clutch 34.

Cams 35 project through windows 38 in guide plate 18 as shown in FIG. 1, the same as the drive rollers 19 and 20.

The purpose of cams 35 is to push and hold the newly received envelope 9 into stack 25, until a subsequent envelope is transported to the inlet window.

The solenoid (not shown) that releases the clutch 34 is actuated when the light path 41 (FIG. 2) between photosensor elements 39 and 40 is broken. Photosensor elements 39 and 40 can be a light emitting diode (LED) and a light detecting phototransistor.

OPERATION OF THE INVENTION

Operation of the invention will be explained, with further reference to FIGS. 3*a* through 3*d.*

Figure 3A:
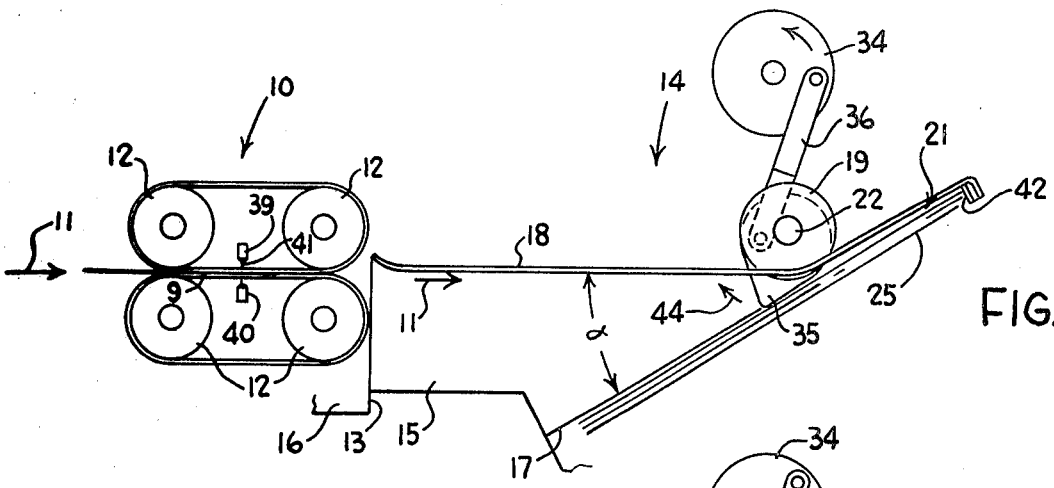
Figure 3B:
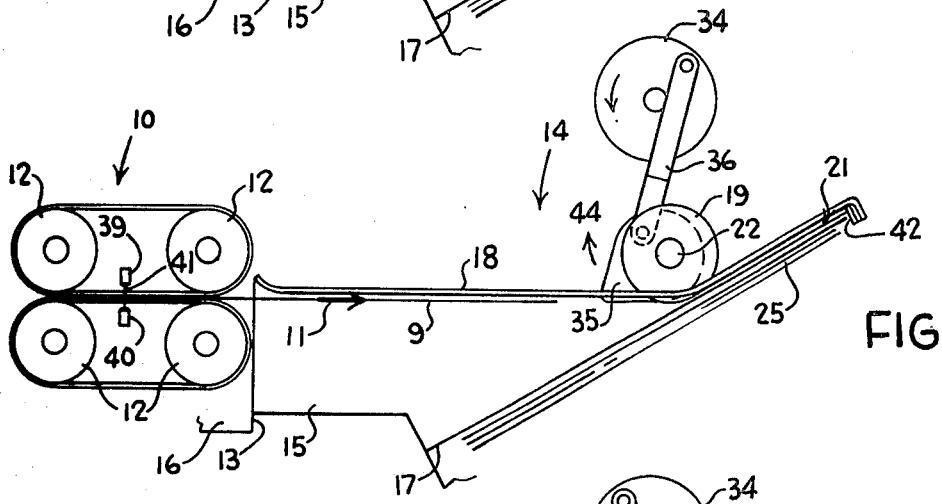
Figure 3C:
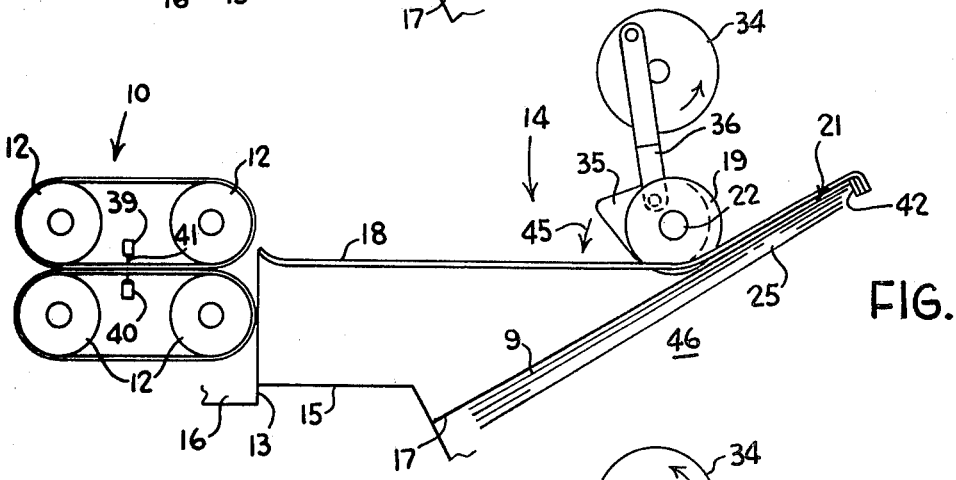

FIG. 3*a* shows an envelope 9 moving along the feed path 11, and entering the transport mechanism 10. As the envelope enters the transport mechanism 10, its leading edge breaks the light path 41 between photosensor elements 39 and 40. A signal is provided to actuate a solenoid (not shown) that releases the single revolution clutch 34. This causes the cams 35 to retract (arrow 44) behind guide plate 18. This frees inlet window to receive the incoming envelope (FIG. 3*b*). Envelope 9 now comes in contact with the driving rollers 19 and 20 (the low friction rolles 19 only contact envelopes that are greater than 5 inches in height). The driving rollers momentarily contact the stack 25 or the plate 26 (first encounter) when the cams 35 are withdrawn. This provides a frictional bite to the incoming envelope 9. Ths causes the envelope 9 to be thrust into slot 21 (FIG. 3*c*). The leading edge of the envelope comes in contact with the shock absorbing surface 42. The shock absorbing surface 42 prevents the envelope 9 from bouncing out of slot 21. Envelope 9 which as to bend about the drive rollers in entering slot 21, now straightens out due to the natural resiliency of the envelope material.

When the envelope 9 comes in contact with surface 42, the trailing end of the envelope which is at an angle $\alpha$ to the slot direction, is caused to conform to the slot direction.

Figure 3D:
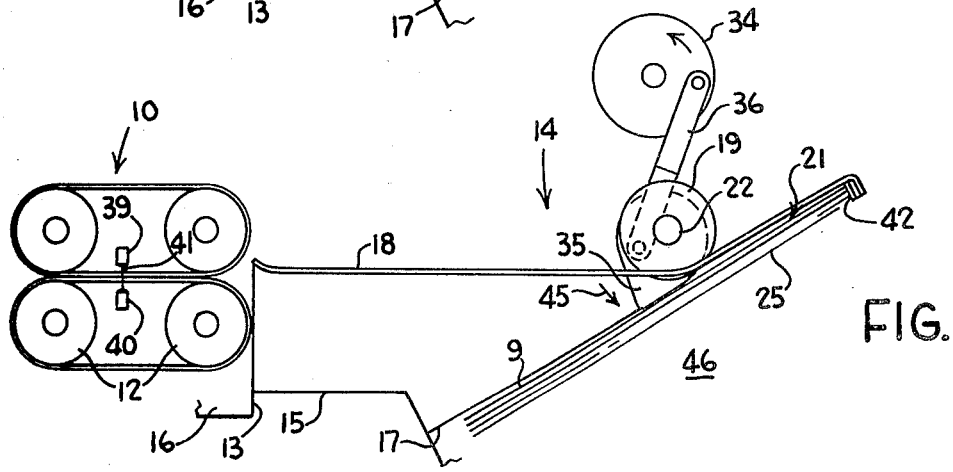

Cams 35 now begin to oscillatae in a forward direction as depicted by arrow 45 in FIG. 3*c*. Cams 35 now come to rest (end of clutch 34 cycle) against envelope 9 (FIG. 3*d*). This forces the envelopes against stack 25. The final travel of cams 35 push the envelope 9 and stack 25 beyond lip 17 on the deck floor 15. Lip 17 drops ¼ (nominal) below the old floor 15 level to provide a new floor 46. The lip 17 aids in holding the stack 25 with the newly recieved envelope 9 at angle $\alpha$. The cams 35 prevent the lead envelope 9 from coming into contact with the continuously rotating drive rollers 19 and 20. This prevents wear and damage to the lead envelope (envelope 9) in the stack 25. This also serves the dual prupose of providing an open inlet window $\alpha$ for the next envelope. A subsequent envelope will now go through te same sequence of events as envelope 9 (FIGS. 3*a*–3*d*).

It must be noted that the speed of the transfer rollers 12 must be compatible with the timing cycle of the clutch 34. This is necessary so as to provide an open inlet window $\alpha$ when an incoming envelope arrives.

Generally speaking, envelopes newly deposited upon the stack 25 wil tend to fall towards the driving rollers 19 and 20, when the cams 35 retract to make ready or an incoming envelope. The incoming envelopes does, however, see a clear inlet window, and is able to enter before the envelopes of the stack 25 can fall toward the drive rollers. This is so, because the envelopes in the stack are moving very slowly (beset by inertia) in comparison to the speeding incoming envelope. In addition, lip 17 will help to retard movement of the stack 25 toward rollers 19 and 20 somewhat, especially where heavier envelopes of the intermixed range are newly deposited.

Rear wall 43 acts to align all the envelopes in stack 25 by their leading edges.

Weight 27 provides a constant force on plate 26, so that envelopes may be removed from the stack without losing stack pressure (plate 26 will move forward to fill the gap).

Lip 13 provides a drop from the transport mechanism 10 to the floor 15, so that the incoming envelope is moving in free flight. This prevents the bottom of the envelope from curling up, thus ruining the trajectory of the envelope in moving towards slot 21.

The wide-angle $\alpha$ of the inlet window provides that the leading edge of the incoming envelope finds easy access to the drive rollers and envelope stack.

While the preceding description describes a deck 46 with a flat surface, the invention can work as efficiently wit a ribbed deck, or a belted deck. When using different deck configurations, lips 13 and 17 will usually assume different values.

Changes such as these, and all others considered obvious to the skilled practitioner are deemed to lie within the scope and spirit of the invention as presented by the appended claims.

What is claimed is:

1. An envelope stacking system for receiving envelopes being transported in seriatim along a feed path and stacking said envelopes in a contiguous stack, said envelopes being transported and stacked with a vertical orientation, said envelope stacking system, comprising:

means defining an envelope feed path;

transporting means disposed along said feed path for feeding envelopes in seriatim to a stacking deck, said transporting means feeding said envelopes with a vertical orientation;

a stacking deck for supporting a stack of vertically oriented envelopes, said deck having means defining an inlet window, said inlet window comprising a guide wall for guiding incoming envelopes, said guide wall having an angle bend;

driving means adjacent said guid wall for recieving incoming envelopes and thrusting them along said guide wall toward a rear portion of said guide wall causing said incoming envelopes to bend to conform to the angle bend of said guide wall;

oscillating camming means diposed adjacent and coaxially with said driving means for moving a newly received envelope agaist the stack of envelopes disposed on said deck, said oscillating camming means holding the newly received envelope against the stack until a subsequent envelope is transported to the stacking deck and approaches the inlet window, the holding of said newly received envelope against the stack serving the dual prupose of eliminating contact of said stack of envelopes with said driving means to prevent wear upon the envelopes of said stack, and in order to clear said inlet window and provide an open inlet for a subsequent incoming envelope; and biasing means supported by the deck for biasing the stack of envelopes toward said driving means.

2. The envelope stacking system of claim 1, further comprising photosensor means disposed along said feed path upstream of said stacking deck for sensing when an envelope is bieng delivered to said stacking means and providing an activating signal to said camming means.

3. The envelope stacking system of claim 1, wherein said stacking deck further comprises a rear wall adjacent said guide wall for maintaining registry between envelopes in said stack, and wherein said driving means moves incoming envelopes toward said rear wall.

4. The envelope stacking system of claim 3, wherin said rear wall has a shock absorbing means disposed thereon for preventing incoming envelopes from bouncing out of the inlet window.

5. The envelope stacking system of claim 1, wherein said driving means comprises at least one rotatable friction wheel for frictionally engaging with incoming envelopes and propelling them along the guide wall.

* * * * *

UNITED STATES PATENT AND TRADEMARK OFFICE

CERTIFICATE OF CORRECTION

PATENT NO. : 4,019,730

DATED : April 26, 1977

INVENTOR(S) : Frederick J. Staudinger - James G. Montagnino

It is certified that error appears in the above-identified patent and that said Letters Patent are hereby corrected as shown below:

Column 1, line 34, after "cannot" insert -- be --.

Column 1, line 54, change "this" to -- thus --.

Column 2, line 9, after "is" insert -- a --.

Column 2, line 25, change "as" to -- has --.

Column 3, line 5, change "fo" to -- of --.

Column 3, line 47, change "rolles" to -- rollers --.

Column 3, line 56, change "as" to -- has --.

Column 4, line 4, change "recieved" to -- received --.

Column 4, line 11, change "te" to -- the --.

Column 4, line 18, change "wil" to -- will --.

Column 4, line 19, change "or" to -- for --.

Column 4, line 46, change "wit" to -- with --.

Claim 1, Column 5, line 1, change "guid" to -- guide -- and change "recieving" to -- receiving --.

Claim 1, Column 5, line 8, change "agaist" to -- against --.

Claim 1, Column 5, line 15, change "prupose" to -- purpose --.

UNITED STATES PATENT AND TRADEMARK OFFICE

CERTIFICATE OF CORRECTION

PATENT NO. : 4,019,730

DATED : April 26, 1977

INVENTOR(S) : Frederick J. Staudinger - James G. Montagnino

It is certified that error appears in the above-identified patent and that said Letters Patent are hereby corrected as shown below:

Claim 2, Column 6, line 6, change "bieng" to -- being --.

Claim 4, Column 6, line 14, change "wherin" to -- wherein --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*